US008319647B2

(12) United States Patent
Chen

(10) Patent No.: US 8,319,647 B2
(45) Date of Patent: Nov. 27, 2012

(54) RFID-BASED ELECTRIC SEAL

(76) Inventor: Chih Chuan Chen, Nantou (TW)

( * ) Notice: Subject to any disclaimer, the term of this patent is extended or adjusted under 35 U.S.C. 154(b) by 407 days.

(21) Appl. No.: 12/800,621

(22) Filed: May 19, 2010

(65) Prior Publication Data

US 2011/0283755 A1 Nov. 24, 2011

(51) Int. Cl.
*G08B 21/00* (2006.01)

(52) U.S. Cl. ..... 340/572.8; 340/572.7; 29/282

(58) Field of Classification Search ..... 340/572.1, 340/572.7, 572.8; 29/282
See application file for complete search history.

(56) References Cited

U.S. PATENT DOCUMENTS 7,298,274 B2 11/2007 Chen et al.

*Primary Examiner* — Jeffery Hofsass
(74) *Attorney, Agent, or Firm* — Charles E. Baxley

(57) ABSTRACT

An electric seal includes an antenna device engaged in a lock member and having a contact located in the lock member, a lock shaft engageable into the lock member and having a circuit board engaged in the bore of the lock shaft and having an RFID chip coupled to an electric circuit, the electric circuit includes a contact for electrically engaging with the contact of the antenna member when the lock shaft is engaged into the compartment of the lock member for identifying the RFID-based electric seal, the RFID chip do not generate and emit the signal to identify the electric seal when the lock shaft is disengaged from the lock member or when the circuit board is disengaged from the antenna member.

15 Claims, 9 Drawing Sheets

RFID-BASED ELECTRIC SEAL

BACKGROUND OF THE INVENTION

1. Field of the Invention

The present invention relates to an electric lock or seal, and more particularly to an RFID-based electric lock or seal using RFID (radio frequency identification) technology to secure and to identify containers or other objects, and including an improved structure for allowing the electric lock or seal to be easily and quickly manufactured and assembled and for suitably decreasing the manufacturing cost for the electric lock or seal.

2. Description of the Prior Art

Typical RFID-based electric locks or seals comprise a complicated structure including a number of parts or elements that are required to be manufactured separated and are then required to be assembled together.

For example, U.S. Pat. No. 7,298,274 to Chen et al. discloses one of the typical passive RFID-based electric locks or seals comprising a complicated structure including a lower body and an upper body, an upper sleeve, a central sleeve, and a lower sleeve, two antennas, an RFID chip, and two sockets that are required to be made or manufactured separated and then required to be assembled together.

However, the great number of parts or elements may not be easily manufactured and assembled, and a large man-power is required to assemble the parts or elements together, such that the manufacturing cost for the electric locks or seals will be greatly increased.

The present invention has arisen to mitigate and/or obviate the afore-described disadvantages of the conventional RFID-based electric locks or seals.

SUMMARY OF THE INVENTION

The primary objective of the present invention is to provide an RFID-based electric seal using RFID technology to secure and to identify containers or other objects and including an improved structure for allowing the electric lock or seal to be easily and quickly manufactured and assembled and for suitably decreasing the manufacturing cost for the electric lock or seal.

In accordance with one aspect of the invention, there is provided an RFID-based electric seal electric seal comprising a lock member including a compartment formed therein, an antenna device engaged in the lock member and including an antenna member having a first contact located in the compartment of the lock member, a lock shaft engageable into the compartment of the lock member and lockable to the lock member, and including a bore formed in the lock shaft, and a circuit board engaged in the bore of the lock shaft and including an electric circuit, and including an RFID chip coupled to the electric circuit, the electric circuit including a second contact for selectively engaging with the first contact of the antenna member and for electrically connecting the electric circuit of the circuit board to the antenna member when the lock shaft is engaged into the compartment of the lock member.

The circuit board includes an end portion extended out of the bore of the lock shaft and folded relative to the lock shaft for anchoring and positioning the circuit board to the lock shaft. The second contact of the circuit board is provided on the end portion of the circuit board.

The lock shaft includes a cap attached to the lock shaft for blocking the bore of the lock shaft and for retaining the circuit board in the bore of the lock shaft. The lock shaft includes a sheath attached onto an outer peripheral portion of the lock shaft for covering the lock shaft.

The lock shaft includes an inclined lower portion, and the circuit board includes an inclined portion for engaging with the inclined lower portion of the lock shaft and for anchoring and positioning the circuit board to the lock shaft.

The lock member includes a retaining ring engaged in the lock member and partially extended into the compartment of the lock member for selectively engaging with the lock shaft and for anchoring and retaining the lock shaft in the compartment of the lock member.

The lock member includes an inclined slot formed in the lock member and communicative with the compartment of the lock member for receiving and engaging with the retaining ring. The lock shaft includes a gasket engaged in the slot of the lock member and engaged with the retaining ring.

A housing may further be provided and includes a chamber formed therein for receiving the lock member. The housing includes a peripheral fence extended upwardly from an upper portion of the housing for forming an opening in the peripheral fence and for communicative with the chamber of the housing.

The housing includes an inclined surface formed in an outer peripheral portion of the peripheral fence, the lock shaft includes a sheath attached onto an outer peripheral portion of the lock shaft, the sheath includes a radially and outwardly extended peripheral skirt for engaging with the inclined surface of the peripheral fence.

The lock member includes a channel laterally formed in a middle portion thereof and communicative with the compartment of the lock member, and the antenna device includes a base member having an intermediate segment engaged in the lateral channel of the lock member, and having two end segments folded relative to the intermediate segment and engaged with the lock member.

The lock member includes a space located in a lower portion of the compartment of the lock member and located below the lateral channel of the lock member, and a spring biasing member engaged in the space of the lock member for engaging with the intermediate segment of the antenna device and for biasing and forcing the first contact of the antenna member to electrically engage with the second contact of the electric circuit of the circuit board. The lock member includes a depression formed therein for engaging with the folded end segments of the base member.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
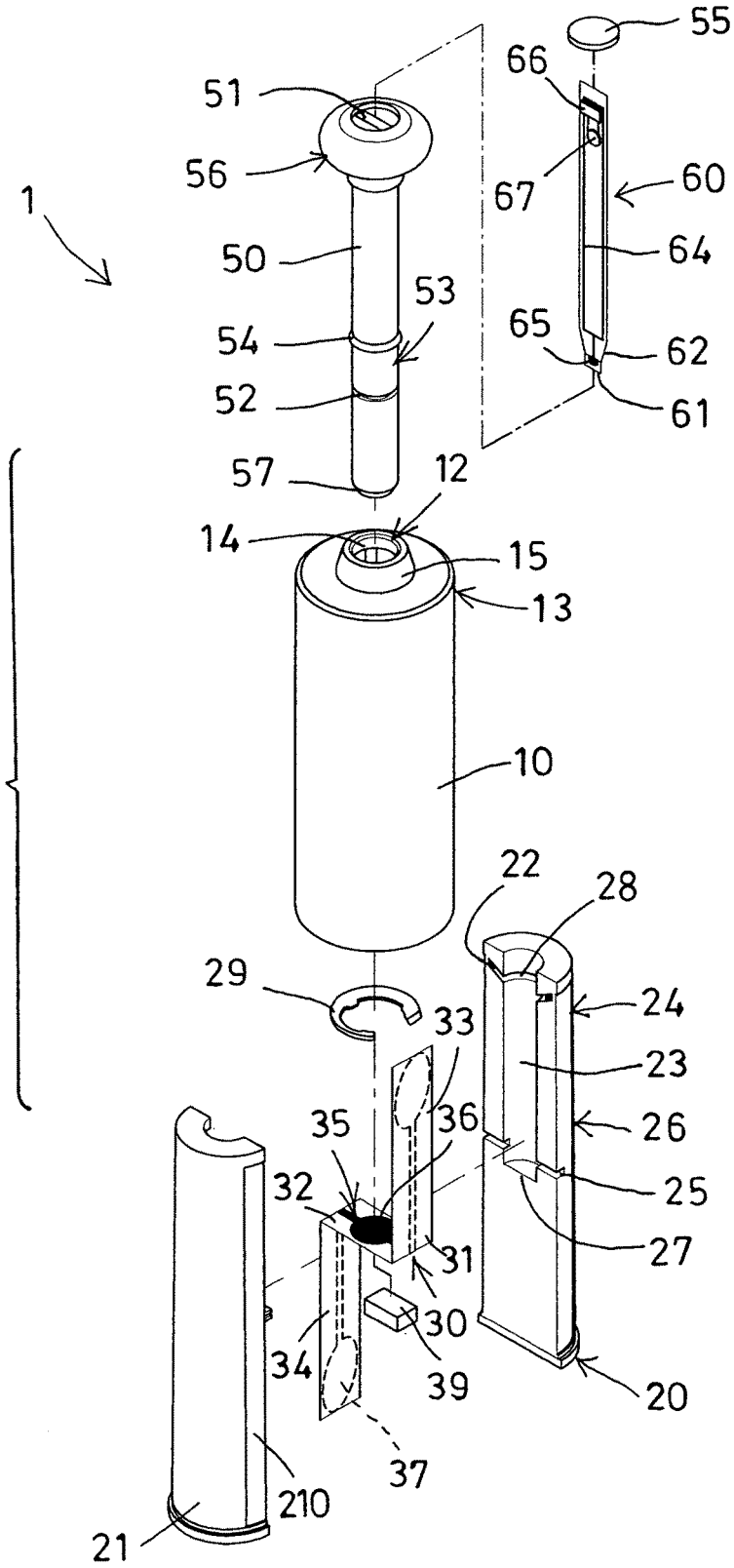
FIG. 1 is a partial exploded view of an RFID-based electric lock or seal in accordance with the present invention.

Referring to the drawings, and initially to FIGS. 1-6, an RFID-based electric seal 1 in accordance with the present invention comprises a lock body or outer housing 10 including a chamber 11 formed therein for receiving or engaging with a core or insert or lock member 20 therein, and including a peripheral fence 12 extended upwardly from the upper portion 13 thereof for forming or defining an opening 14 in the peripheral fence 12 and communicative with the chamber 11 of the housing 10, and including a tilted or inclined surface 15 formed in the outer peripheral portion of the peripheral fence 12. The lock member 20 is engaged into the chamber 11 of the housing 10 and solidly mounted or secured to the housing 10 with adhesive materials or by welding processes.

For example, the lock member 20 includes one or more (such as two) lock elements 21 engaged into and retained in the chamber 11 of the housing 10, and includes a blind hole or compartment 23 formed therein, such as formed in the upper portion 24 thereof and opened upwardly, and includes a channel 25 laterally formed in the middle portion 26 thereof and intersecting or communicative with the compartment 23 of the lock member 20 for forming or defining a space 27 in the lower portion of the compartment 23 of the lock member 20 and located below the lateral channel 25 of the lock member 20, and includes a tilted or inclined slot 28 formed in the upper portion 24 thereof and intersecting or communicative with the compartment 23 of the lock member 20.

It is to be noted that the two lock elements 21 may also be solidly mounted or secured together with such as adhesive materials or by welding processes for forming an integral lock member 20 without the outer housing 10, and the compartment 23 of the lock member 20 may be provided for receiving or engaging with a lock shaft 50 (FIGS. 2-6). A clamping or retaining ring 29 is received or engaged in the tilted or inclined slot 28 of the lock member 20 and is partially extended or engaged into the compartment 23 of the lock member 20 for selectively engaging with the lock shaft 50 (FIGS. 3-5) and for solidly or stably anchoring or positioning or retaining the lock shaft 50 in the compartment 23 of the lock member 20. A washer or sealing ring or gasket 22 may further be provided and engaged with the slot 28 of the lock member 20 and preferably, but not necessarily engaged with the retaining ring 29 for solidly or stably anchoring or positioning or retaining the retaining ring 29 in the slot 28 of the lock member 20.

An antenna device 30 includes a flexible plate or panel or base member 31 having a middle or intermediate segment 32 received or engaged in the lateral channel 25 of the lock member 20, and having two end segments 33, 34 bent or folded relative to the intermediate segment 32 and contacted or engaged with the lock elements 21 or the lock member 20, and having an antenna member 35 printed or applied or attached onto the flexible base member 31, in which the antenna member 35 includes a contact 36 formed or provided on the intermediate segment 32 and located in the compartment 23 of the lock member 20, and two antenna segments 37 formed or provided on the end segments 33, 34 respectively. It is preferable that the lock member 20 includes one or more (such as two) cut off portions or depressions 210 formed in the side portions of the lock elements 21 or of the lock member 20 for receiving or engaging with the bent or folded end segments 33, 34 of the flexible base member 31.

The lock shaft 50 includes a slit or bore 51 formed therein for receiving or engaging with a circuit board 60 therein, and includes a peripheral groove 52 formed in the middle portion 53 thereof for selectively engaging with the retaining ring 29 and for solidly or stably locking or retaining the lock shaft 50 in the compartment 23 of the lock member 20, and includes a gasket or sealing ring 54 attached or mounted onto the middle portion 53 of the lock shaft 50 for selectively engaging with the peripheral fence 12 or the housing 10 (FIGS. 3-5) and for making a water tight seal between the lock shaft 50 and the housing 10, and includes a cap 55 attached or mounted or secured to the upper portion 56 of the lock shaft 50 for blocking or sealing the upper portion of the bore 51 of the lock shaft 50 and for stably anchoring or positioning or retaining the circuit board 60 in the bore 51 of the lock shaft 50.

The lock shaft 50 further includes a tilted or tapered or inclined portion 57 formed or provided on the lower portion thereof for selectively engaging with the circuit board 60 and for further stably anchoring or positioning or retaining the circuit board 60 in the bore 51 of the lock shaft 50. It is preferable, but not necessarily that the lock shaft 50 further includes an outer covering or sheath 58 applied or attached onto the outer peripheral portion of the upper portion 56 of the lock shaft 50 (FIGS. 2, 3, and 6) for further blocking or sealing or covering the upper portion of the bore 51 of the lock shaft 50 and for preventing the humidity or liquid or water from entering into the bore 51 of the lock shaft 50 and for suitably protecting the circuit board 60 from being damaged by the humidity or liquid or water. The sheath 58 includes a radially and outwardly extended lower peripheral skirt 59 for engaging with the inclined surface 15 of the peripheral fence 12 of the housing 10 and for firmly and sealingly engaged with the housing 10.

Figure 8:
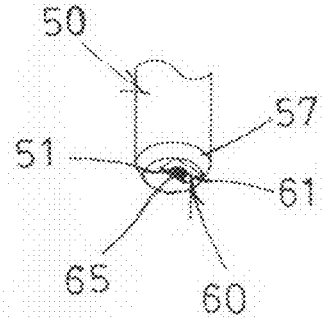
FIG. 8 is an enlarged partial perspective view of the RFID-based electric lock or seal.

It is preferable that the circuit board 60 includes a lower end portion 61 extended out of the bore 51 of the lock shaft 50 and bent or folded relative to the lock shaft 50 (FIG. 8) for further stably anchoring or positioning or retaining the circuit board 60 to the lock shaft 50 and for preventing the circuit board 60 from being disengaged from the lock shaft 50, and the circuit board 60 may further include a tilted or tapered or inclined portion 62 formed or provided on the lower end portion 61 thereof for selectively engaging with the inclined portion 57 of the lock shaft 50 and for further stably anchoring or positioning or retaining the circuit board 60 to the lock shaft 50 and for further preventing the circuit board 60 from being disengaged from the lock shaft 50.

The circuit board 60 includes an electric circuit 64 printed or applied or attached onto the circuit board 60, and includes a contact 65 formed or provided on the lower or bottom portion thereof for selectively engaging with the contact 36 of the antenna member 35 and for selectively and electrically coupling or connecting the electric circuit 64 to the antenna member 35, and includes an RFID chip 66 and one or more batteries 67 attached or mounted or coupled or connected to the electric circuit 64 for identifying the identity of the RFID-based electric seal 1 when the electric circuit 64 is electrically coupled or connected to the antenna member 35. It is preferable that a cushioning or spring biasing member 39 is further provided and disposed or engaged in the space 27 of the lock member 20 and for selectively engaging with the intermediate segment 32 of the antenna device 30 and for selectively biasing and forcing the contact 36 of the antenna member 35 to selectively and electrically or suitably engage with the contact 65 of the electric circuit 64 of the circuit board 60.

Figure 2:
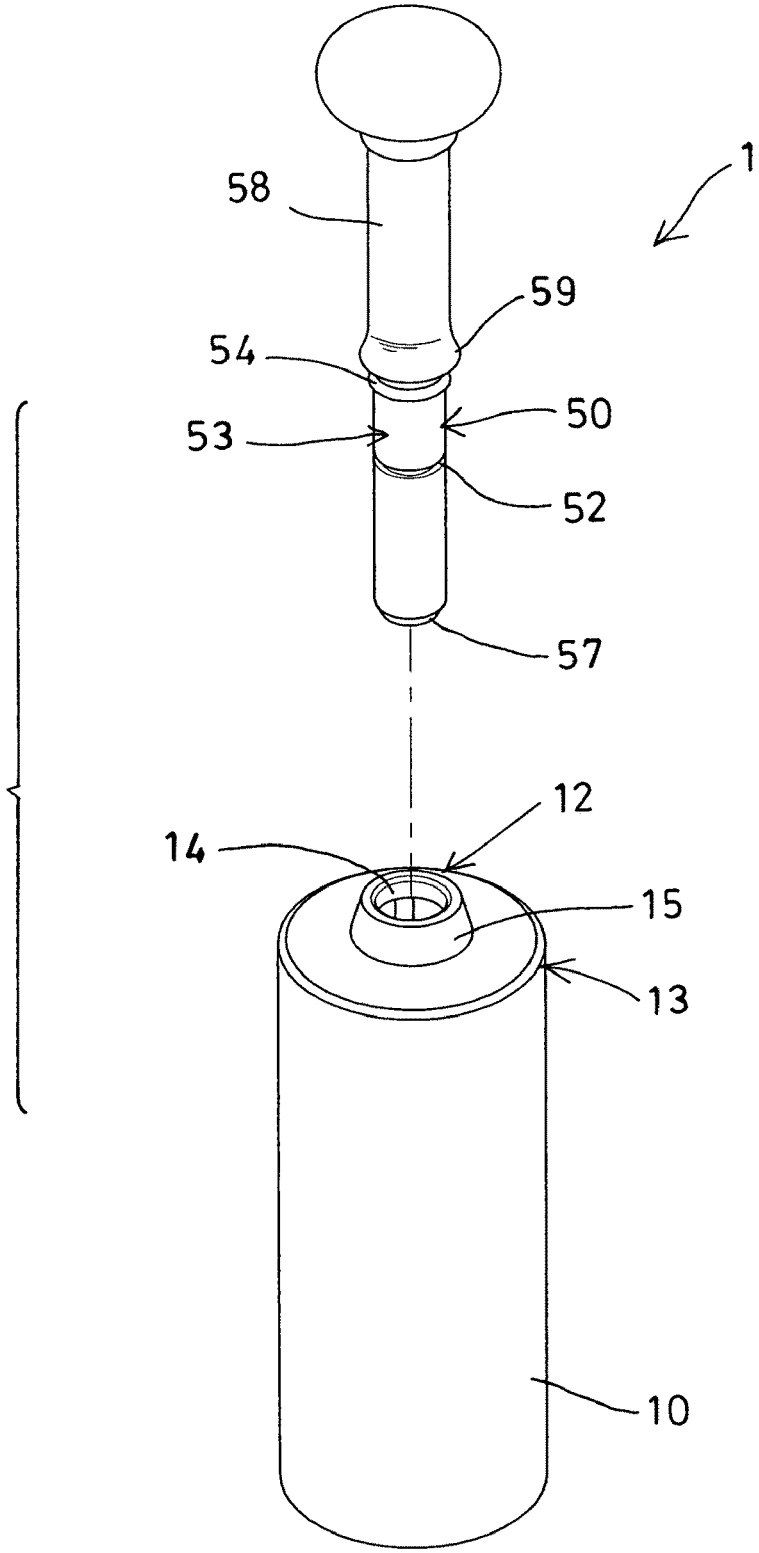
FIG. 2 is another partial exploded view of the RFID-based electric lock or seal.
Figure 3:
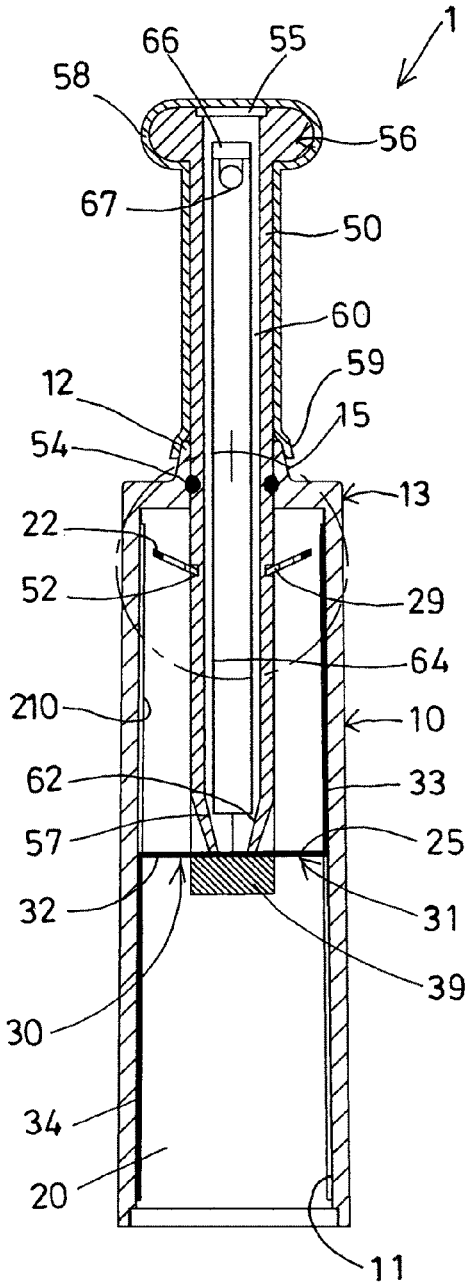
FIG. 3 is a cross sectional view of the RFID-based electric lock or seal.
Figure 4:
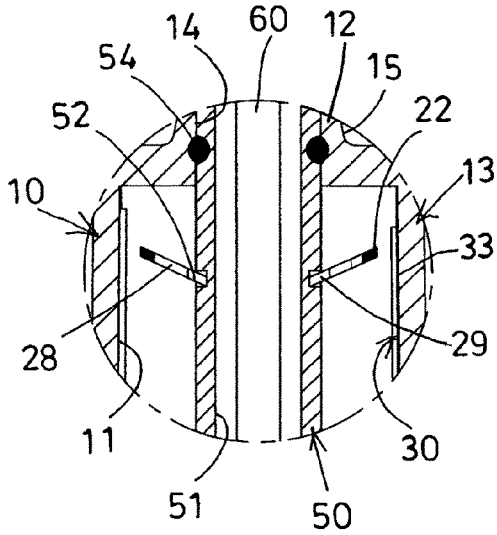
FIG. 4 is an enlarged partial cross sectional view of the RFID-based electric lock or seal.
Figure 5:
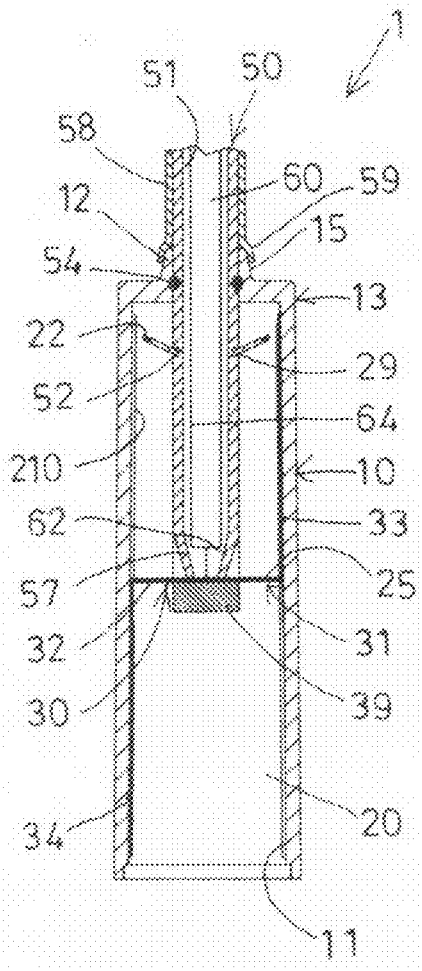
FIG. 5 is a further partial cross sectional view of the RFID-based electric lock or seal.
Figure 6:
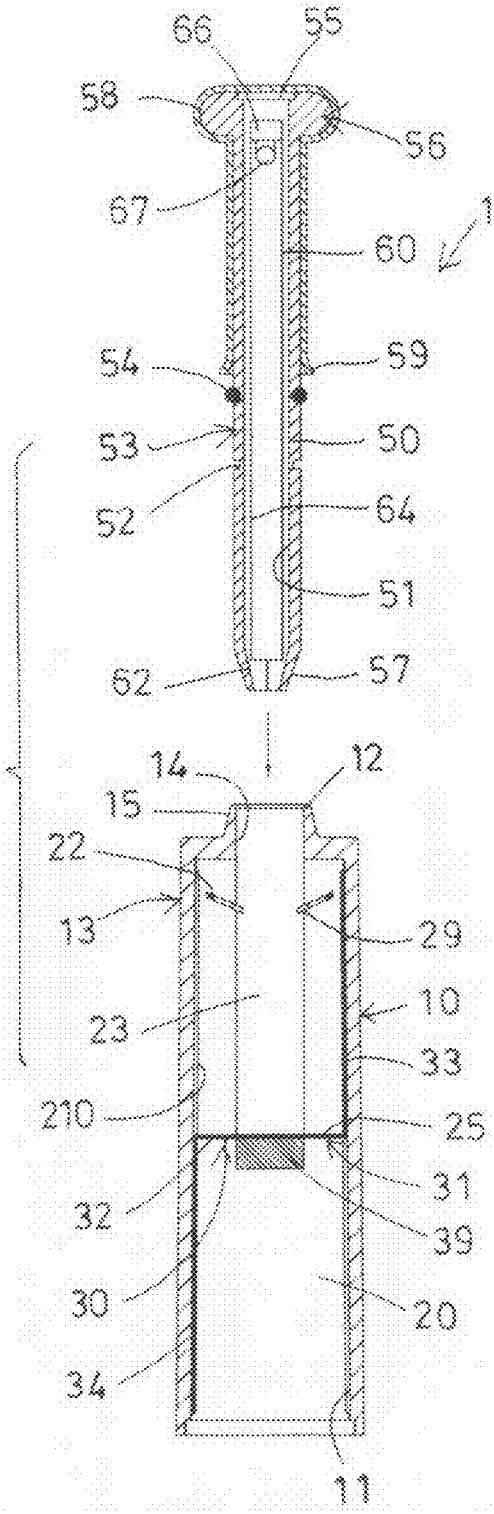
FIG. 6 is an exploded and cross sectional view of the RFID-based electric lock or seal.
Figure 7:
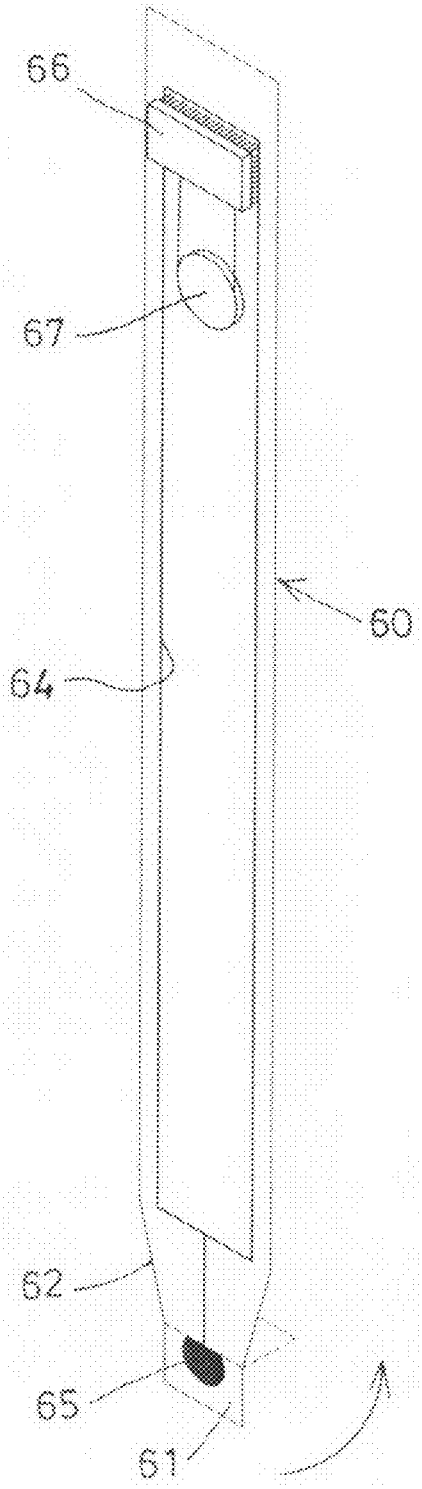
FIG. 7 is a perspective view illustrating a circuit board of the RFID-based electric lock or seal.

In operation, as shown in FIGS. 2 and 6, the lock shaft 50 may be selectively engaged into the opening 14 of the peripheral fence 12 or of the housing 10, and then engaged into the compartment 23 of the lock member 20 until the retaining ring 29 is engaged with the peripheral groove 52 of the lock shaft 50 (FIGS. 3-5) and thus for stably anchoring or positioning or retaining or locking the lock shaft 50 to the lock member 20 or the housing 10, the spring biasing member 39 may be engaged with the intermediate segment 32 of the antenna device 30 (FIGS. 3, 5) for selectively biasing and forcing the contact 36 of the antenna member 35 to selectively and electrically or suitably engage with the contact 65 of the electric circuit 64 of the circuit board 60, and the RFID chip 66 may be used to generate or emit a signal to identify the identity of the RFID-based electric seal 1.

When the lock shaft 50 is disengaged from the lock member 20 or the housing 10, or when the contact 65 of the electric circuit 64 of the circuit board 60 is disengaged from the contact 36 of the antenna member 35 of the lock member 20 or of the housing 10, the electric circuit 64 of the circuit board 60 will be switched off and the RFID chip 66 may no longer be used to generate or emit the signal to identify the identity of the RFID-based electric seal 1, such that a remote control center (not shown) may realize or know that the lock shaft 50 has been disengaged from the lock member 20 or the housing 10, or that the RFID-based electric seal 1 has been damaged by unauthorized persons.

Figure 9:
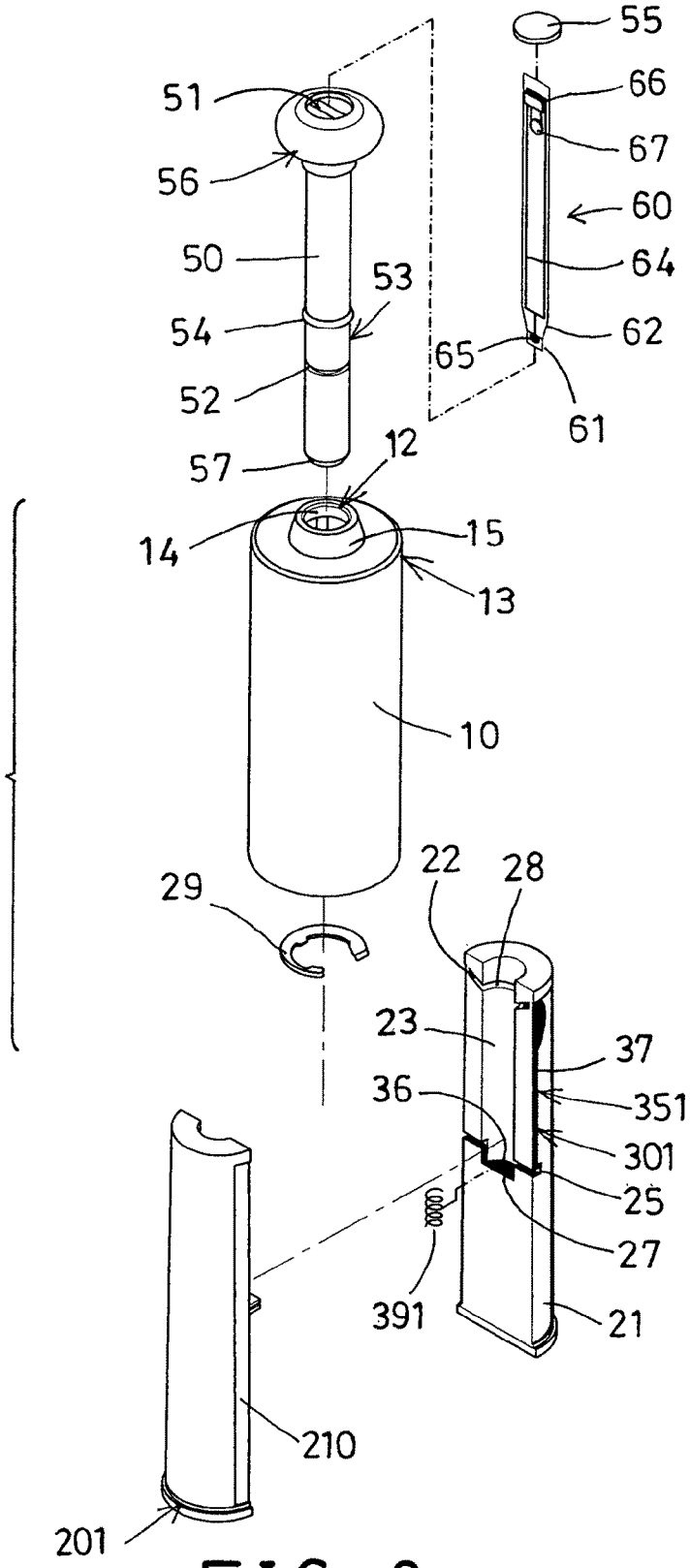
FIG. 9 is a further partial exploded view illustrating the other arrangement of the RFID-based electric seal.

Alternatively, as shown in FIG. 9, the antenna member 351 of the antenna device 301 may be directly printed or applied or attached onto the lock elements 21 of the lock member 201, and the contact 36 of the antenna member 351 may be directly printed or applied or positioned in the space 27 of the lock member 201, and a spring biasing member 391 may further be provided and disposed or engaged in the space 27 of the lock member 201 for selectively engaging with the contact 36 of the antenna member 351 of the antenna device 30 and for selectively and electrically or suitably engaging with the contact 65 of the electric circuit 64 of the circuit board 60.

Figure 10:
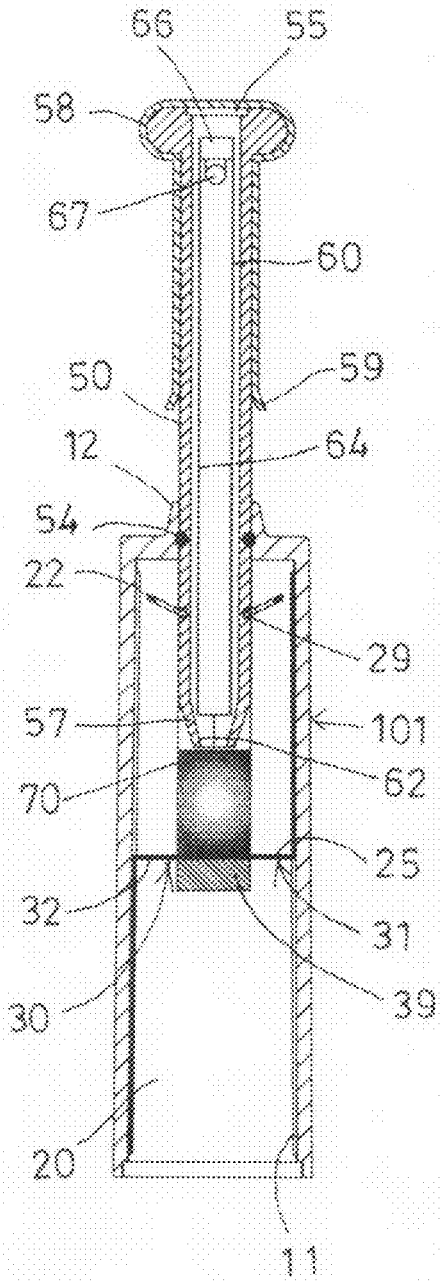
FIG. 10 is a cross sectional view illustrating the further arrangement of the RFID-based electric seal.
Figure 11:
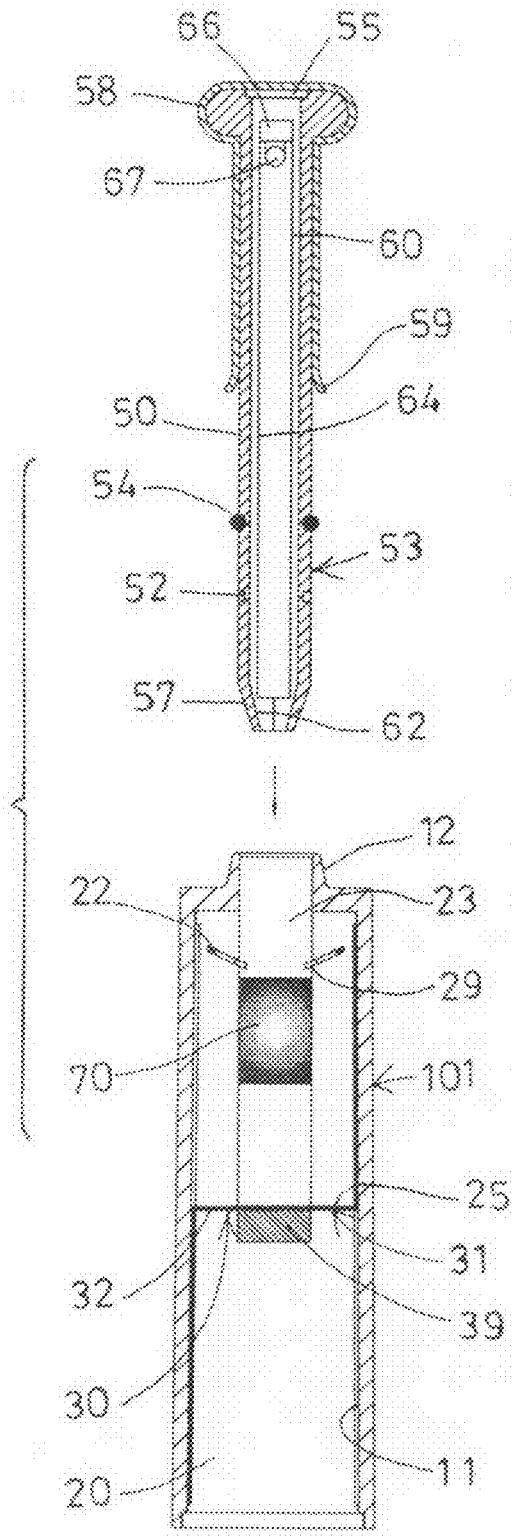
FIG. 11 is an exploded and cross sectional view of the RFID-based electric seal as shown in FIG. 10.

Further alternatively, as shown in FIGS. 10 and 11, a trigger device 70 may further be provided and engaged with or into the compartment 23 of the lock member 20 of the housing 101 for being forced to selectively engage with the intermediate segment 32 of the antenna device 30 and to selectively engage with the contact 36 of the antenna member 35 and thus to selectively and electrically or suitably couple or engage the contact 65 of the electric circuit 64 of the circuit board 60 with the contact 36 of the antenna member 35, the trigger device 70 may include a GPS module (not shown), an interface (not shown), one or more batteries (not shown) for energizing the GPS module and the interface, and one or more switches (not shown) for switching or controlling the trigger device 70, and for receiving signals from satellites or the like, and for generating or emitting the signal to identify the identity of the RFID-based electric seal 1.

Figure 12:
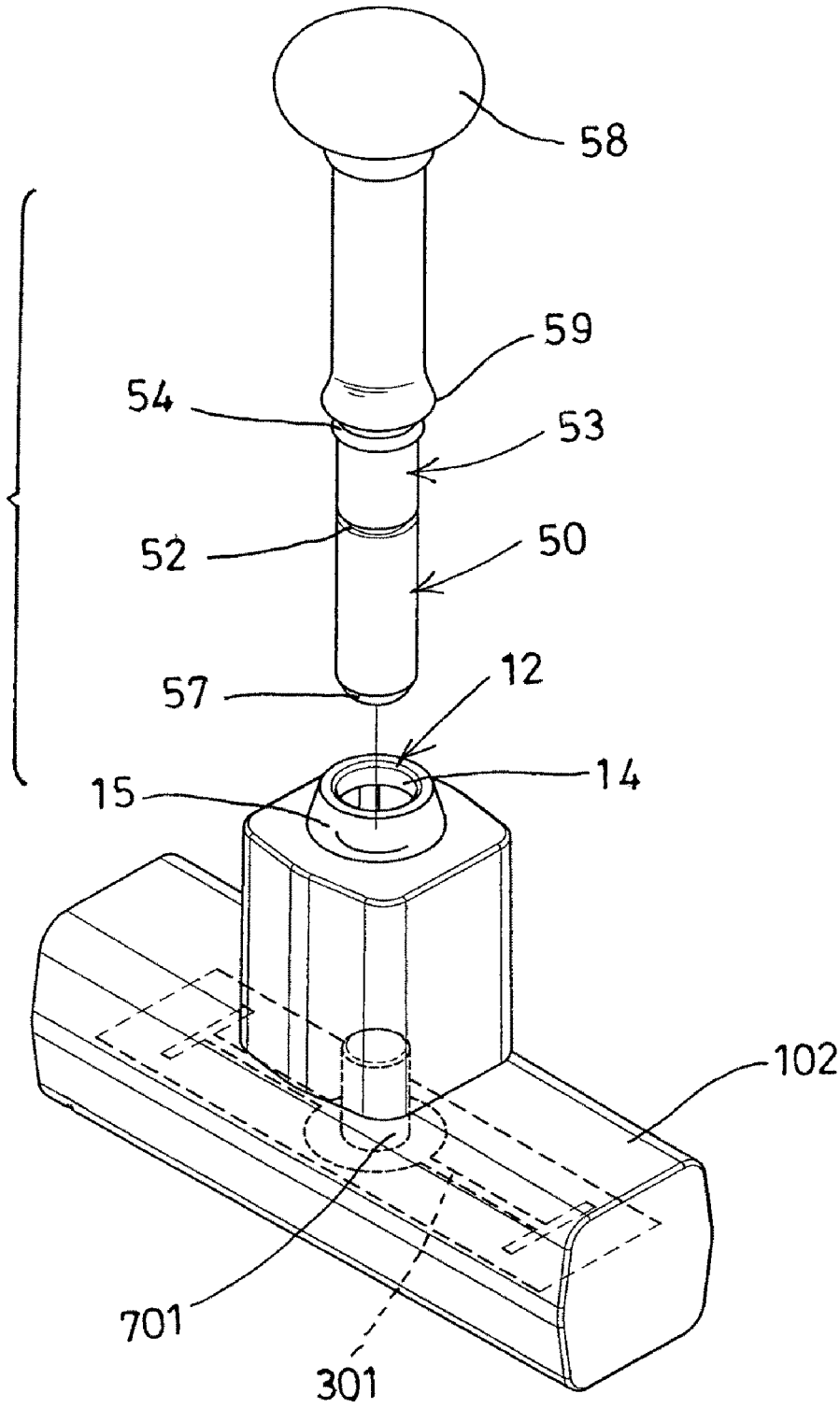
FIG. 12 is a partial exploded view illustrating the still further arrangement of the RFID-based electric seal.
Figure 13:
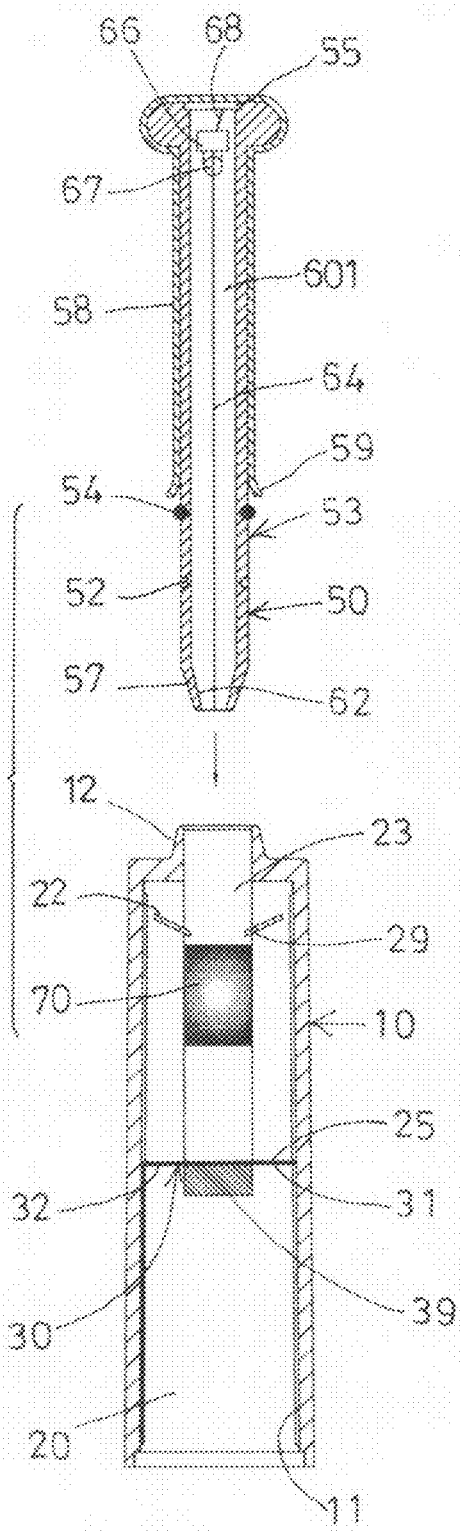
FIGS. 13 and 14 are further exploded and cross sectional views illustrating the still further arrangement of the RFID-based electric seal.
Figure 14:
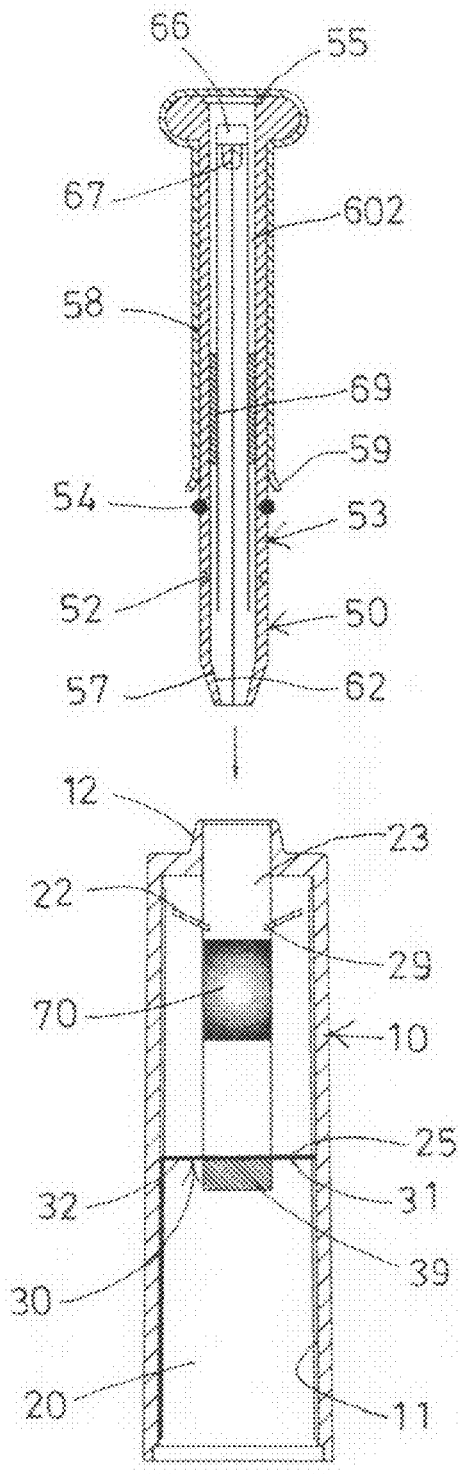

Further alternatively, as shown in FIG. 12, the housing 102 may be formed into various kinds of shapes of configurations or contours having the antenna device 301 provided and disposed or engaged in the housing 102, and a trigger device 701 may further be provided and engaged into the housing 101 for selectively and electrically coupling or connecting the antenna device 301 to the contact 65 of the electric circuit 64 of the circuit board 60. Further alternatively, as shown in FIG. 13, the circuit board 601 may include an electric wire or cable 68 electrically coupled or connected to the RFID chip 66 or the electric circuit 64 of the circuit board 601, or further alternatively, as shown in FIG. 14, the circuit board 602 may include a conductive collar or cylindrical member 69 attached thereto and electrically coupled or connected to the electric circuit 64 of the circuit board 602.

Accordingly, the RFID-based electric seal in accordance with the present invention includes an improved structure for allowing the electric lock or seal to be easily and quickly manufactured and assembled and for suitably decreasing the manufacturing cost for the electric lock or seal.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An electric seal comprising:

a lock member including a compartment formed therein, an antenna device engaged in said lock member and including an antenna member having a first contact located in said compartment of said lock member, a lock shaft engageable into said compartment of said lock member and lockable to said lock member, and including a bore formed in said lock shaft, and a circuit board engaged in said bore of said lock shaft and including an electric circuit, and including an RFID chip coupled to said electric circuit, said electric circuit including a second contact for selectively engaging with said first contact of said antenna member and for electrically connecting said electric circuit of said circuit board to said antenna member when said lock shaft is engaged into said compartment of said lock member.

2. The electric seal as claimed in claim 1, wherein said circuit board includes an end portion extended out of said bore of said lock shaft and folded relative to said lock shaft for anchoring and positioning said circuit board to said lock shaft.

3. The electric seal as claimed in claim 2, wherein said second contact of said circuit board is provided on said end portion of said circuit board.

4. The electric seal as claimed in claim 1, wherein said lock shaft includes a cap attached to said lock shaft for blocking said bore of said lock shaft and for retaining said circuit board in said bore of said lock shaft.

5. The electric seal as claimed in claim 1, wherein said lock shaft includes a sheath attached onto an outer peripheral portion of said lock shaft for covering said lock shaft.

6. The electric seal as claimed in claim 1, wherein said lock shaft includes an inclined lower portion, and said circuit board includes an inclined portion for engaging with said inclined lower portion of said lock shaft and for anchoring and positioning said circuit board to said lock shaft.

7. The electric seal as claimed in claim 1, wherein said lock member includes a retaining ring engaged in said lock member and partially extended into said compartment of said lock member for selectively engaging with said lock shaft and for anchoring and retaining said lock shaft in said compartment of said lock member.

8. The electric seal as claimed in claim 7, wherein said lock member includes an inclined slot formed in said lock member and communicative with said compartment of said lock member for receiving and engaging with said retaining ring.

9. The electric seal as claimed in claim 8, wherein said lock shaft includes a gasket engaged in said slot of said lock member and engaged with said retaining ring.

10. The electric seal as claimed in claim 1 further comprising a housing including a chamber formed therein for receiving said lock member.

11. The electric seal as claimed in claim 10, wherein said housing includes a peripheral fence extended upwardly from an upper portion of said housing for forming an opening in said peripheral fence and for communicative with said chamber of said housing.

12. The electric seal as claimed in claim 11, wherein said housing includes an inclined surface formed in an outer peripheral portion of said peripheral fence, said lock shaft includes a sheath attached onto an outer peripheral portion of said lock shaft, said sheath includes a radially and outwardly extended peripheral skirt for engaging with said inclined surface of said peripheral fence.

13. The electric seal as claimed in claim 1, wherein said lock member includes a channel laterally formed in a middle portion thereof and communicative with said compartment of said lock member, and said antenna device includes a base member having an intermediate segment engaged in said lateral channel of said lock member, and having two end segments folded relative to said intermediate segment and engaged with said lock member.

14. The electric seal as claimed in claim 13, wherein said lock member includes a space located in a lower portion of said compartment of said lock member and located below said lateral channel of said lock member, and a spring biasing member engaged in said space of said lock member for engaging with said intermediate segment of said antenna device and for biasing and forcing said first contact of said antenna member to electrically engage with said second contact of said electric circuit of said circuit board.

15. The electric seal as claimed in claim 13, wherein said lock member includes a depression formed therein for engaging with said folded end segments of said base member.

* * * * *